United States Patent [19]

Engle et al.

[11] 4,320,896

[45] Mar. 23, 1982

[54] SHOCK-ABSORBING ASSEMBLY FOR BASKETBALL BACKBOARD

[75] Inventors: Charles J. Engle; Robert A. Boitano, both of St. Louis, Mo.

[73] Assignee: Gared Corporation, St. Louis, Mo.

[21] Appl. No.: 192,682

[22] Filed: Oct. 1, 1980

[51] Int. Cl.[3] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 1,757,350 | 5/1930 | Wallace | 273/1.5 R |
| 2,267,222 | 12/1941 | Sandeberg | 273/1.5 R |
| 3,233,897 | 2/1966 | Sheets | 273/1.5 R |
| 3,462,143 | 8/1969 | Bidelman et al. | 273/1.5 R |
| 4,111,420 | 9/1978 | Tyner | 273/1.5 R |

OTHER PUBLICATIONS

Slam Dunk Rim Inc., Advertising Circular, 4–1978.

*Primary Examiner*—Paul E. Shapiro

*Attorney, Agent, or Firm*—Kalish & Gilster

[57] ABSTRACT

A basketball goal-backboard unit comprising a backboard of glass, a rigid frame surrounding the backboard, a shock-absorbing assembly comprising a front plate and a rear plate disposed in registering relationship forwardly and rearwardly, respectively, of the backboard. Cushioning panels are snugly disposed between the backboard adjacent faces of the front and rear plates and the backboard, and with the basketball goal incorporating a mounting element disposed on the forward face of the front plate. A single bolt interengages the basketball goal mounting element, the front and rear plates, and the cushioning panels. A fluid cylinder may be presented rearwardly of the backboard, being mounted upon the frame, and having a piston operatively engaged at the rearward plate.

10 Claims, 6 Drawing Figures

SHOCK-ABSORBING ASSEMBLY FOR BASKETBALL BACKBOARD

BACKGROUND AND SUMMARY OF THE INVENTION

This invention relates in general to basketball equipment and more particularly to shock absorbing assemblies for installation upon basketball backboards to enhance resistance thereof to damage through forces applied during the course of a game.

Heretofore, there has been increasingly utilized by basketball players a particular scoring shot referred to as a "dunk" shot whereby the player, having jumped a sufficient height, is enabled to drive the basketball downwardly through the basket from a point immediately thereabove. In the course of performing this particular shot, a player will most consistently effect a most forceful contact with the basket by either slapping, hitting, or pulling upon same with his hands, wrists, or arms. This last mentioned contact with substantial consistency tends to be so forceful that the backboard which is recognizedly of temper-plate glass is stressed beyond its elastic limits and thus completely shatters. A glass backboard, as of the type used in professional, college, and high school, is of an area of 24 square feet so that the quantity of broken glass which is sprayed about constitutes a hazard of serious proportions; providing both a potential to injury to the players as well as the spectators who are nearby. In addition to the marked possibility of personal injury, such damage represents a severe economic loss in view of the need for replacement and the necessary re-installation. Moreover, such damage can also cause a cessation of the particular game with a disruption as to the rights of the ticket holders.

Heretofore, very limited efforts have been made to try to render backboards resistant to dunk damage and the lack of success of such few efforts has caused the problem to remain unsolved yet being deprecated by players and on-lookers alike. Among such unsatisfying efforts are the structures set forth in the U.S. Pat. Nos. 4,111,420 and 4,191,734. These patents while revealing shock absorbing means, as of cylindrical nature, disclose pivotal mountings for the basketball goal. Thus, the goal is mounted for forward rocking about a hinged axis parallel to the plane of the backboard so that the goal will rock downwardly under the force of the dunk shot. Similarly, the goal is mounted for rockable movement as about an axis perpendicular to the plane of the backboard so that the goal is thereby free to rock laterally. In addition, these patents provide structure so that the entire backboard would be free to rock. It can be appreciated that these structures are of such complex character that the same cannot be easily and economically adopted for usage. The use of the same would necessitate a replacement of all existing backboards and this would represent an economical loss of infinite proportions. Consequently, these structures have not been adopted as the utilization is not economically feasible.

Another effort to prevent the destruction of basketball backboards through performance of the dunk shot is shown in U.S. Pat. No. 4,151,989, but admittedly the basketball goal shown therein is intended solely for practice purposes as it is located at the end of a cantilever boom which has associated shock absorbing members in its zone proximate the supporting upright. But manifestly, this device is not even suggested as being amenable for game purposes and furthermore does not incorporate any element corresponding to a backboard.

Therefore, it is an object of the present invention to provide a shock absorbing assembly for a basketball backboard fabricated of shatterable material, such as glass, which may be easily and cheaply mounted upon existing backboards and which does not in any way alter the normal disposition of the basketball goal which is at all times rigidly presented in its customary, accepted manner.

It is a further object of the present invention to provide a shock absorbing assembly for use with basketball goals which uniquely protect a frangible backboard against the normal destructive forces applied through the exercising of the dunk shot without modifying the backboard or the goal in any manner as to cause the goal to be misplaced or to be displacable from its usual manner of presentation.

It is another object of the present invention to provide a shock absorbing assembly for basketball backboards which comprises a marked paucity of parts, all of which are of simple construction and of extreme durability so that replacement of any of such components is of marked unlikelihood.

It is a further object of the present invention to provide a shock absorbing assembly for basketball backboards which provides no element of interference with the usual playing of the game of basketball; the components of which assembly may be most economically manufactured; which assemblies are extremely reliable in usage; and which assemblies may be installed upon existing backboards without the necessity of engaging highly skilled individuals.

DESCRIPTION OF THE PRACTICAL EMBODIMENTS

Figure 1:
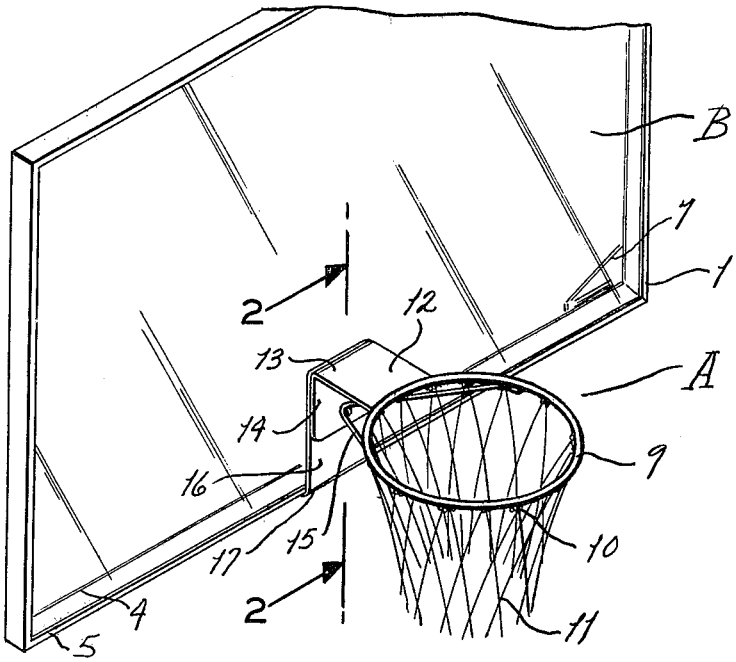
FIG. 1 is a prospective view of a basketball goal-backboard unit incorporating a shock-absorbing assembly constructed in accordance with and embodying the present invention.

Referring now by reference characters to the drawings which illustrate practical embodiments of the present invention, A designates a basketball goal as mounted upon a backboard B which may be of any selected contour, such as rectangular, fan-shaped, etc., and which is conventionally constructed of glass set within a frame 1, as of steel. For purposes of illustration only, backboard B is shown as of rectangular form and with frame having a base portion 2 planarwise parallel with the adjacent, confronting edge surface 3 of backboard B but being of greater transverse extent. Slightly rearward of the longitudinal center line of each frame base portion 2, there is provided a continuous, inner flange 4 being planarwise perpendicular to the adjacent frame base portion 2. Throughout the forward edge of frame 1 there is provided an inturned retaining rim 5 planarwise parallel to flange 4 and cooperating therewith to define a continuous channel 6 for receiving the edge portions of glass backboard B. Although it is not part of the present invention, cushioned material, such as a vinyl channel molding m, may be disposed between backboard B and the accepting portions of channel 6.

Figure 4:
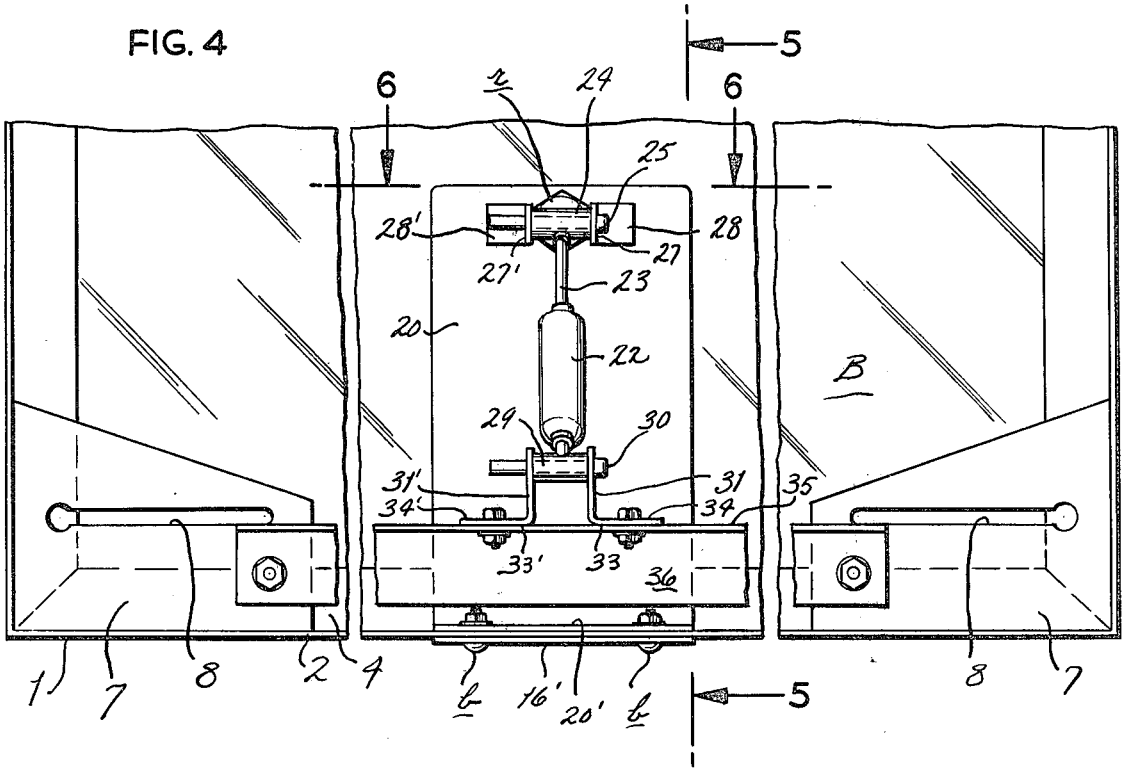
FIG. 4 is a fragmentary rear view of a basketball goal-backboard unit incorporating another form of shock-absorbing assembly constructed in accordance with and embodying the present invention.

As may best be seen in FIG. 4, the usual backboard mounting brackets 7 may be bolted or otherwise fixedly secured to the corner portions of frame 1 rearwardly of inner flange 4; said bracket 7 being provided with the usual keyhole slots 8 for facilitation of installation with concomitant lateral adjustability.

The foregoing thus exemplifies the usual backboard construction as meeting specifications for professional, college, and high school basketball.

Figure 2:
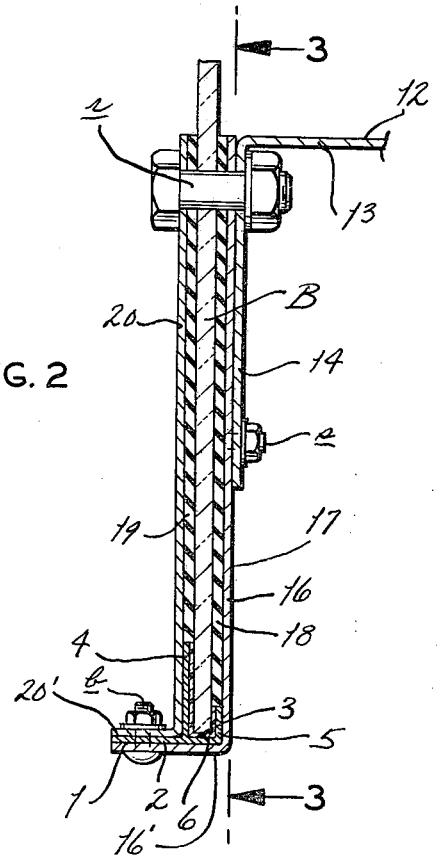
FIG. 2 is a vertical, transverse sectional view taken on the line 2—2 of FIG. 1.
Figure 3:
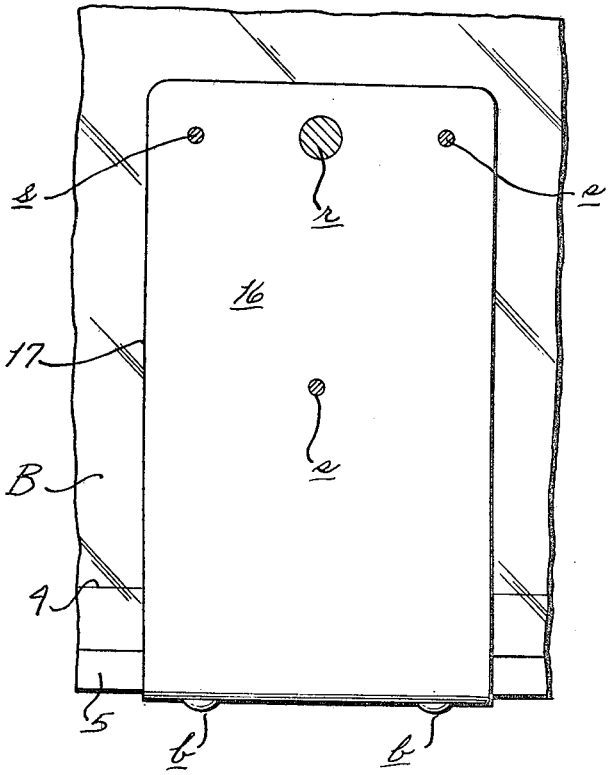
FIG. 3 is a vertical view, in partial section, taken on the line 3—3 of FIG. 2.

Basketball goal A comprises the usual ring or annulus 9, as formed of round steel stock, and having fixed, as by welding, on its undersurface a plurality of circumferencially spaced net hooks 10 for suspension of the usual net 11. Basketball goal A also comprehends the usual mounting 12 which latter comprises a horizontal component 13 and a vertical component 14 which extends downwardly from the rearward end of horizontal component 13 in perpendicular relationship thereto. The usual brace rods 15 interengage ring 9 and vertical component 14 of mounting 12 being rigidly secured by welding. Mounting vertical component 14 abuts on its rearward surface against the upper portion of the front plate 16 of a shock absorbing assembly 17; said front plate 16 being of like transverse extent as said vertical component 14 but being of substantially relatively increased length for spanning the distance to the lower edge of frame 1 whereat it is turned rearwardly to present an under flange 16′ for disposition beneath base portion 2 of the bottom of frame 1 and extending sufficiently rearwardly for projecting beyond flange 4 (see FIG. 2). It will thus be seen that by reason of retaining rim 5 front plate 16 will, on its rearward surface upwardly of said rim 5, be spaced immediately forwardly of the adjacent portion of glass backboard B; with such spacing being filled by a resilient or shock absorbing panel 18 as formed of rubber, synthetic or natural, or other suitable material; said panel 18 being thus sandwiched snugly between front plate 16 and glass backboard B with said panel 18 being desirably of registering contour with said front plate 16. In alignment with panel 18 is a companion cushioning panel 19 located on the opposite side of glass backboard B and in full registration with panel 18 but with its lower edge being received upon the upper edge of flange 4. Said panel 19 is interposed between said backboard B and back plate 20 which, together with front plate 16 and side panels 18, 19, constitutes assembly 17. With reference to FIG. 2, it will be seen that back plate 20 is in registration with front plate 16 and at its lower end incorporates a rearwardly turned flange 20′ overlying the adjacent base portion 2 of frame 1 in registering relationship with relation to flange 16′ whereby said flanges 16′, 20′ are presented on opposite sides of the intervening base portion 2 of frame 1 in a sandwich manner. It will thus be seen that the lower forward portion of back plate 20 abuts against the rearward surface of the pertinent portion of flange 4. Bolts, as at b, extending through the aligned openings in flanges 16′, 20′ and the engaged portions of frame 1 reliably secure the lower portion of shock absorbing assembly 17 upon frame 1. Front plate 16 and back plate 20, together with the intervening panels 18, 19 and backboard B, are suitably drilled for receiving a relatively large retention bolt r for tightly joining the upper portion of shock absorbing assembly 17 upon backboard B.

The usual studs s which normally engage basketball goal mounting 12 upon the particular backboard serve to secure said mounting upon front plate 16.

Therefore, in view of the foregoing, it will be seen that basketball goal A is effectively engaged to the glass backboard B but by a single bolt which is of a relatively enlarged character thereby obviating the multiplicity of openings which have been required heretofore within the glass by reason of receiving the multiplicity of studs s, usually four in number, for securing basketball goal mounting vertical component 14. Thus, by the reduction of a number of such openings within the glass, the latter is materially strengthened and thus will be more resistant to breakage or rupture through applied forces within the zone of such openings. Additionally, it is to be observed that shock absorbing assembly 17 is effectively secured to the metal frame as through flanges 16′, 20′ so that impact received by said plates through force acting upon basketball goal ring 9 will be transmitted to frame 1 which, being of steel or the like, is markedly superior to glass for withstanding damage from any such forces. Nevertheless, and of extreme importance, is the provision of cushioning means between front plate 16 and back plate 20 so that any forces not transmitted to frame 1 will be dissipated through the resiliency and hence vibrancy of the said cushioning panels 18, 19 thereby providing crucial strength to the glass backboard B.

It will, therefore, be seen that should a player, in the course of a game, seek to exercise the so-called dunk shot with attendant application of force upon the basketball goal A as by slapping, hitting, or pulling upon such goal, the force of such effort will be diffused through the frame 1 and the resilient panels 18, 19 as above indicated thereby preventing the shattering of the backboard with the attendant potential for injury to players as well as spectators in the vicinity, not to mention the economic loss occasioned by the damage to the backboard.

It is to be particularly noted that the present invention is indeed unique in that it may be installed upon existing backboards without necessitating any extensive modification thereof. In essence, all that would be required would be the appropriate drilling for bolt r within goal vertical component 14 and backboard B and with drilling in the base portion 2 for bolts b. It will be noted that front plate 16 incorporates studs s for engaging the predrilled openings in goal vertical component 14. Therefore, the present invention can be very quickly and cheaply installed on existing backboards by the usual handyman obviating the need for highly technical, outside skilled artisans.

Figure 5:
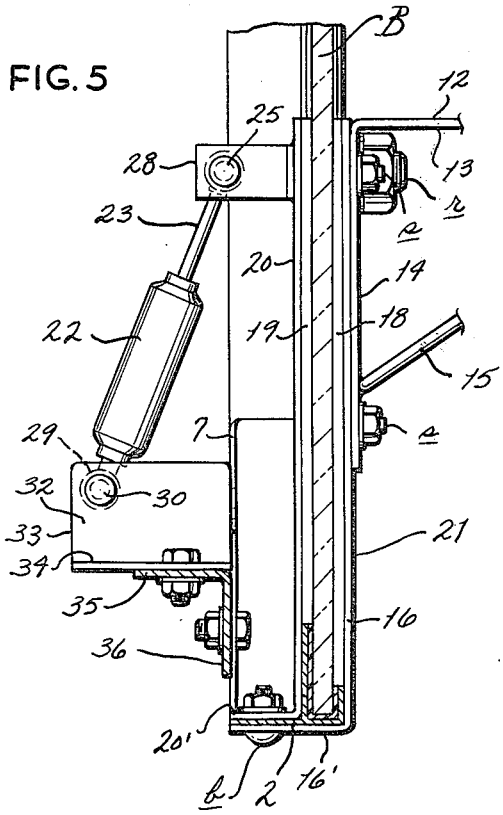
FIG. 5 is a vertical, transverse sectional view taken on the line 5—5 of FIG. 4.
Figure 6:
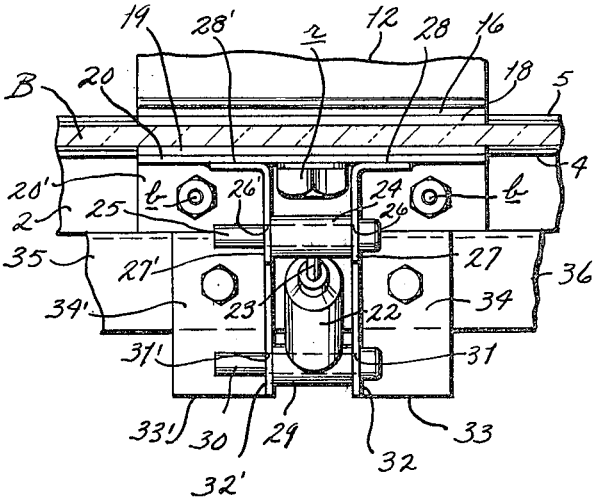
FIG. 6 is a horizontal, transverse sectional view taken on the line 6—6 of FIG. 4.

Turning now to FIGS. 4, 5, 6, another form of shock absorbing assembly 21 is shown which may be utilized with backboard B for rendering same resistant to damage by impacts caused by the dunk shot. As shock absorbing assembly 21 embodies certain components as found in shock absorbing assembly 17, it is understood that like elements will bear like references numerals. Thus, shock absorbing assembly 21 comprises a front plate 16, a back plate 20 having then respective flanges 16′, 20′ engaged by bolts to the base portion of frame 1.

Basketball goal A is engaged as heretofore described upon front plate 16 and with bolt r securing said plates 16, 20 and the sandwiched glass backboard therebetween, as well as the cushioning panels 18, 19.

Provided for enhancing the force dissipating capacity of shock absorbing assembly 21 is a fluid cylinder 22 having a piston 23 extending from the upper end of said cylinder; said piston 23 at its cylinder-remote extremity having a relatively short transversely extending sleeve 24 through which extends an elongated hinge pin 25. Pin 25 projects through aligned apertures 26, 26' formed in the ears 27, 27', respectively, of angle brackets 28, 28', respectively, for rigidly mounting on the rearwardly directed face of back plate 20 in the upper portion thereof so brackets 28, 28' are suitably spaced so that sleeve 24 may be presented unimpededly between ears 27, 27' and with the bore thereof being aligned with apertures 26, 26'. The lower end of cylinder 22 is similarly mounted for commensurate rockable movement and having a short sleeve 29 fixed to the lower end of cylinder 22 for receiving a hinge pin 30 which projects through apertures 31, 31' of ears 32, 32', respectively, of angle brackets 33, 33', respectively, which latter are rigidly mounted, as by bolts in their lower horizontal flanges 34, 34', upon the horizontal flange 35 of an elongated angle section 36; the ends of the latter being secured as by bolts to the proximate frame mounting brackets 7 (FIG. 5). It will thus be seen that by reason of hinge pins 25, 30 cylinder 22 is capable of rocking about its longitudinal axis through any compression and resulting extension of piston 23 to thereby provide an acceptance of the forces applied upon backboard B by reason of the utilization of the dunk shot. Thus, cylinder 22 is simply an auxiliary expedient which may be used to provide further insurance against damage from the energy inflicted upon backboard B by the dunk shot. It will, of course, be readily seen that shock absorbing assembly 21 may be as easily installed upon existing backboards B as shock absorbing assembly 17 hereinabove described since time-consuming and costly modification of backboard B is not necessitated.

What is claimed is:

1. A basketball goal-backboard unit comprising in combination a planar backboard constructed of glass, a rigid frame engaging the edge portion of said backboard throughout its peripheral extent, a shock absorbing assembly comprising a front plate and a back plate disposed in registering relationship forwardly and rearwardly, respectively, of said backboard, means securing said front and back plates upon said frame, resilient means sandwiched snugly between said front and back plates and said backboard for absorbing shock, a basketball goal, means engaging said goal upon the backboard-remote face of said front plate, and means interconnecting said means engaging said goal and said shock absorbing assembly.

2. A basketball goal-backboard unit as defined in claim 1 wherein said resilient means are panels constructed of resilient material and substantially coinciding with the proximate plate.

3. A basketball goal-backboard unit as defined in claim 2 wherein said resilient panels are constructed of material from the class consisting of synthetic rubber, natural rubber, and resinous cushioning materials.

4. A basketball goal-backboard unit as defined in claim 1 wherein said rigid frame includes a base flange extending rearwardly of said backboard, said front and back plates contain rearwardly extending flanges at the lower ends thereof for disposition, respectively, below and above said frame base flange, and said means engaging said plates to said frame being fasteners securing said front and back plate flanges to said frame base flange.

5. A basketball goal-backboard unit as defined in claim 4 wherein said interconnecting means comprising a bolt, there being aligned openings in said front and rear plates, said resilient means, and said backboard, said bolt extending through said aligned openings.

6. A basketball goal-backboard unit as defined in claim 5 wherein said goal-engaging means comprising a mounting having a horizontal component and a vertical component, said goal being secured at one end of said horizontal component and said vertical component projecting downwardly from the opposite end of said horizontal component, and elements securing said vertical component upon the upper portion of the backboard-remote face of said front plate.

7. A basketball goal-backboard unit as defined in claim 1 wherein a fluid cylinder is provided in said shock absorbing assembly, and means operatively engaging said cylinder to said rear plate.

8. A basketball goal-backboard unit as defined in claim 7 wherein said cylinder engaging means comprises first bracket elements mounted on the backboard-remote face of said rear plate, said cylinder having a piston, means engaging the cylinder-remote end of the piston upon said first bracket elements, and means carried on said frame mountingly supporting said cylinder.

9. A basketball goal-backboard unit as defined in claim 8 wherein the means engaging the piston to said first bracket element comprises a first hinge pin having the axis thereof extending transversely of said backboard and perpendicular to the longitudinal axis of said piston, said cylinder mounting means comprising second bracket elements, a second hinge pin operativey engaged to the proximate end of said cylinder whereby under impact of force acting upon said backboard said cylinder is adapted for rockable movement with concurrent axial movement of said piston.

10. A basketball goal-backboard unit as defined in claim 9 and further characterized by said second bracket elements located below and rearwardly of said first bracket elements with said cylinder being mounted in upwardly and forwardly inclined relationship with its upper piston-engaging end being located nearer to said backboard than the opposite, lower end thereof.

* * * * *

UNITED STATES PATENT AND TRADEMARK OFFICE

CERTIFICATE OF CORRECTION

PATENT NO. : 4,320,896

DATED : March 23, 1982

INVENTOR(S) : Charles J. Engle and Robert A. Boitano

It is certified that error appears in the above-identified patent and that said Letters Patent are hereby corrected as shown below:

In the Heading, after "Assignee" "Gared Corporation" should be ---Gared Company---

Signed and Sealed this

*Nineteenth* Day of *June 1984*

[SEAL]

*Attest:*

GERALD J. MOSSINGHOFF

*Attesting Officer*

*Commissioner of Patents and Trademarks*